US012202695B2

(12) United States Patent
Shiobara

(10) Patent No.: US 12,202,695 B2
(45) Date of Patent: Jan. 21, 2025

(54) POST PROCESS DEVICE AND RECORDING SYSTEM

(71) Applicant: SEIKO EPSON CORPORATION, Tokyo (JP)

(72) Inventor: Hiroshi Shiobara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/296,768

(22) Filed: Apr. 6, 2023

(65) Prior Publication Data

US 2023/0322518 A1 Oct. 12, 2023

(30) Foreign Application Priority Data

Apr. 8, 2022 (JP) ..... 2022-064561

(51) Int. Cl.
*B65H 37/00* (2006.01)

(52) U.S. Cl.
CPC ..... *B65H 37/00* (2013.01); *B65H 2402/44* (2013.01); *B65H 2801/27* (2013.01)

(58) Field of Classification Search
CPC ..... G03G 15/6582; G03G 21/1619; G03G 21/1642; H04N 1/00559; H04N 1/00562; B65H 37/00; B65H 2402/30; B65H 2402/40; B65H 2402/44; B65H 2402/441; B65H 2405/353; B65H 2801/27
USPC ..... 270/58.07, 58.13; 399/110
See application file for complete search history.

(56) References Cited

U.S. PATENT DOCUMENTS 7,821,681 B2 * 10/2010 Matsumoto ..... H04N 1/00519 358/401
9,381,760 B2 * 7/2016 Egawa ..... B41J 29/02
11,420,665 B2 * 8/2022 Tokonami ..... B62B 3/02
11,661,299 B2 * 5/2023 Kakuta ..... B65H 31/02 271/264

FOREIGN PATENT DOCUMENTS

JP 2019-115988 A 7/2019

* cited by examiner

*Primary Examiner* — Leslie A Nicholson, III
(74) *Attorney, Agent, or Firm* — WORKMAN NYDEGGER

(57) ABSTRACT

A post process device 200 configured to perform a post process on a medium received from a recording device 10, includes a post process section 60 configured to perform the post process, an installation section 112 disposed below the post process section 60 in the gravity direction, a first leg section 106 that is fixed to the installation section 112 and that extends from the installation section 112 toward the post process section 60, a second leg section 108 that is fixed to the installation section 112 at a position different from the first leg section 106 and that extends from the installation section 112 toward the post process section 60, a control section 201 configured to control an operation of the post process device 200, and a control section support 202 configured to support the control section 201 and configured to connect the first leg section 106 and the second leg section 108.

15 Claims, 15 Drawing Sheets

POST PROCESS DEVICE AND RECORDING SYSTEM

The present application is based on, and claims priority from JP Application Serial Number 2022-064561, filed Apr. 8, 2022, the disclosure of which is hereby incorporated by reference herein in its entirety.

BACKGROUND

1. Technical Field

The present disclosure relates to a post process device and a recording system.

2. Related Art

In the related art, various post process devices have been used to perform post process on a medium received from a recording device. For example, JP-A-2019-115988 discloses an image forming system in which a relay transport unit having a support section is disposed in a discharge area disposed inside an image forming device, a sheet is transported from an image forming unit to a post process unit installed on the support section by the relay transport unit, and a post process is performed in the post process unit.

In the image forming system of JP-A-2019-115988, the relay transport unit has the support section, and the post process unit is installed on the support section of the relay transport unit. In such a configuration, for example, when medium stoppage occurs in the image forming device, the support section becomes an obstacle and it becomes difficult to access the inside of the image forming device from the post process unit side. Therefore, for example, in order to avoid such a situation, a configuration in which the post process section is supported by the leg sections so as to provide a space for accessing the inside of the image forming device can be considered. However, in the configuration in which the post process section is supported by the leg section, there is a case where the structure is complicated in order to stably support the post process section, for example, a reinforcing member for reinforcing the leg section is separately provided.

SUMMARY

A post process device for solving the above-described problem according to the present disclosure is a post process device configured to perform post process on a medium received from a recording device, post process device including a post process section configured to perform the post process; an installation section disposed below the post process section in a gravity direction; a first leg section that is fixed to the installation section and that extends from the installation section toward the post process section; a second leg section that is fixed to the installation section at a position different from the first leg section and that extends from the installation section toward the post process section; a control section configured to control an operation of the post process device; and a control section support configured to support the control section and to connect the first leg section and the second leg section to each other.

In addition, a recording system for solving the above-described problem according to the present disclosure, A recording system includes a recording device configured to perform recording on a medium and a post process device configured to perform a post process on the medium received from the recording device, wherein the post process device includes a post process section configured to perform the post process, an installation section disposed below the post process section in a gravity direction, a first leg section that is fixed to the installation section and that extends from the installation section toward the post process section, a second leg section that is fixed to the installation section at a position different from the first leg section and that extends from the installation section toward the post process section, a control section configured to control an operation of the post process device, and a control section support configured to support the control section and to connect the first leg section and the second leg section to each other.

DESCRIPTION OF EMBODIMENTS

Figure 1:
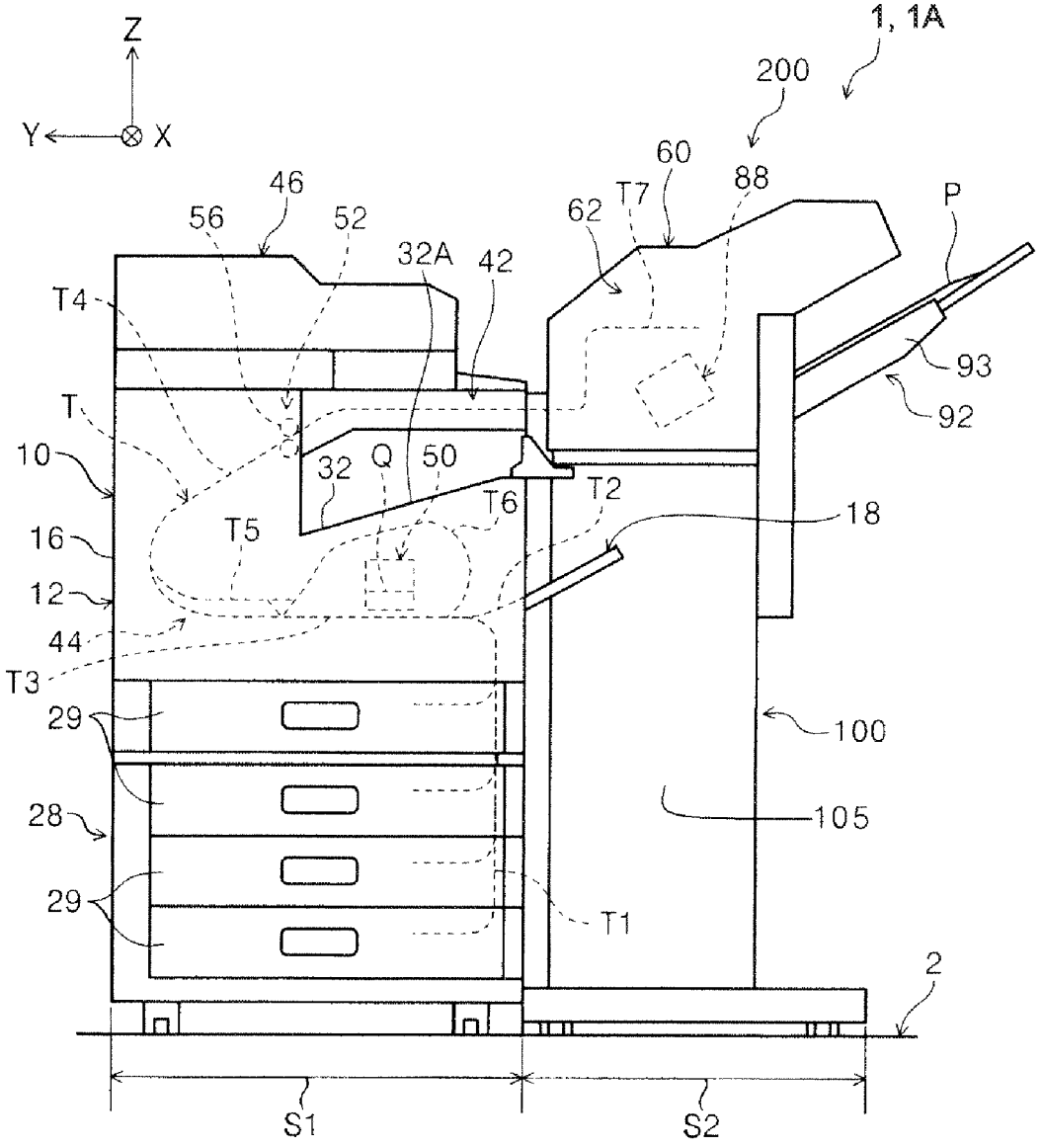
FIG. 1 is a front view showing an overall configuration of a recording system according to a first embodiment of the present disclosure.

Hereinafter, the present disclosure will be schematically described.

A post process device according to a first aspect is a post process device configured to perform a post process on a medium received from a recording device, the post process device including a post process section configured to perform the post process; an installation section disposed below the post process section in a gravity direction; a first leg section that is fixed to the installation section and that extends from the installation section toward the post process section; a second leg section that is fixed to the installation section at a position different from the first leg section and that extends from the installation section toward the post process section; a control section configured to control an operation of the post process device; and a control section support configured to support the control section and to connect the first leg section and the second leg section to each other.

According to this aspect, the control section support is provided for connecting the first leg section and the second leg section. That is, by adopting a configuration in which a constituent member that can be said to be essential, that is, the control section support that supports the control section that controls the operation of the post process device, to connect the first leg section and the second leg section together, then it is possible to give it the additional role of stably supporting the post process section. Therefore, the post process section can be stably supported without complicating the structure of the device such as by providing a separate reinforcing member.

The post process device according to a second aspect is according to the first aspect, wherein the first leg section, the second leg section, and the control section support include metal members and the metal member of the first leg section and the metal member of the control section support are in contact with each other, and the metal member of the second leg section and the metal member of the control section support are in contact with each other.

According to this aspect, the metal member of the first leg section and the metal member of the control section support are in contact with each other, and the metal member of the second leg section and the metal member of the control section support are in contact with each other. Since the metal member has high conductivity, with such a configuration, the number of electrical contact points between the first leg section and the second leg section increases, and generation of a large potential difference between the first leg section and the second leg section can be suppressed.

The post process device according to a third aspect is according to the first or second aspect, wherein the control section support is box shaped and the control section is housed in the control section support.

According to this aspect, the control section is housed in the box shaped control section support. Therefore, the control section support can physically protect the control section, and the control section support can take on a role of an electromagnetic shield of the control section.

The post process device according to a fourth aspect is according to the first or second aspect, further including a power supply section configured to supply electricity to the post process section and a power supply section support configured to support the power supply and to connect the first leg section and the second leg section to each other.

According to this aspect, the power supply section support that supports the power supply section and that connects the first leg section and the second leg section is provided. Therefore, by adopting a configuration in which the power supply section support that supports the power supply section is connected to the first leg section and to the second leg section, then it is possible to give it the additional role of stably supporting the post process section. Therefore, the post process section can be more stably supported without complicating the structure of the device such as by providing a separate reinforcing member.

The post process device according to a fifth aspect is according to the fourth aspect, wherein the power supply section is disposed below the control section in the gravity direction.

According to this aspect, the power supply section is disposed below the control section in the gravity direction. Since the power supply section is generally heavy, disposing the power supply section below the control section in the gravity direction can lower the centroid of the post process device and can improve the installation stability of the post process device.

The post process device according to a sixth aspect is according to the fourth aspect, wherein the control section support is provided to extend in a direction that intersects a direction in which the first leg section and the second leg section extend, and has a contact surface in surface contact with the power supply section.

According to this aspect, the control section support is provided to extend in the direction that intersects the direction in which the first leg section and the second leg section extend, and has a contact surface in surface contact with the power supply section. Therefore, in addition to the power supply section support, the control section support is brought into surface contact with the power supply section to support the power supply section, and thus the power supply section can be particularly stably supported. Further, by adapting a configuration in which the control section support has the contact surface extending in the direction that intersects the direction in which the first leg section and the second leg section extend, it will have the contact surface in a parallel cross shape with respect to the first leg section and the second leg section, and thus the post process section can be particularly stably supported.

The post process device according to a seventh aspect is according to the fourth aspect, wherein a socket that is configured to supply electricity from outside to the power supply section and that is provided on a side surface of at least one of the first leg section and the second leg section, the side surface being a surface in a direction in which the first leg section and the second leg section overlap.

According to this aspect, the socket configured to supply electricity from the outside to the power supply section is provided on the side surface of at least one of the first leg section and the second leg section. With such a configuration, it is easy to miniaturize the post process device, and usability with respect to the socket from the side surface side is improved.

The post process device according to an eighth aspect is according to the fourth aspect, further including an air cooling section configured to air cool the power supply section and an air cooling section support configured to support the air cooling section and to connect the first leg section and the second leg section to each other.

According to this aspect, the air cooling section support configured to support the air cooling section and to connect the first leg section and the second leg section together is provided. Therefore, by adopting a configuration in which the air cooling section support that supports the air cooling section is connected to the first leg section and the second leg section, then it is possible to give it the additional role of stably supporting the post process section. Therefore, the post process section can be more stably supported without complicating the structure of the device such as by providing a separate reinforcing member.

The post process device according to a ninth aspect is according to the first or second aspect, further including a tray configured to place the medium on which the post process is performed; a drive section configured to change a position of the tray in the gravity direction; and a drive section support configured to support the drive section and to connect the first leg section and the second leg section to each other.

According to this aspect, the drive section support configured to support the drive section and to connect the first leg section and the second leg section is provided. Therefore, by adopting a configuration in which the drive section support that supports the drive section is connected to the first leg section and the second leg section, then it is possible to give it the additional role of stably supporting the post process section. Therefore, the post process section can be more stably supported without complicating the structure of the device such as by providing a separate reinforcing member.

The post process device according to a tenth aspect is according to the first or second aspect, wherein the control section is provided so as to overlap with the first leg section and the second leg section as viewed from a direction in which the first leg section and the second leg section overlap.

According to this aspect, the control section is provided so as to overlap with the first leg section and the second leg section as viewed from a direction in which the first leg section and the second leg section overlap. With such a configuration, it is easy to miniaturize the post process device.

The recording system according to an eleventh aspect is a recording system including a recording device configured to perform recording on a medium and a post process device configured to perform a post process on the medium received from the recording device, wherein the post process device includes a post process section configured to perform the post process, an installation section disposed below the post process section in a gravity direction, a first leg section that is fixed to the installation section and that extends from the installation section toward the post process section, a second leg section that is fixed to the installation section at a position different from the first leg section and that extends from the installation section toward the post process section, a control section configured to control an operation of the post process device, and a control section support configured to support the control section and to connect the first leg section and the second leg section to each other.

According to this aspect, the control section support is provided for connecting the first leg section and the second leg section. That is, by adopting a configuration in which a constituent member that can be said to be essential, that is, the control section support that supports the control section that controls the operation of the post process device, to connect the first leg section and the second leg section together, then it is possible to give it the additional role of stably supporting the post process section. Therefore, the post process section can be stably supported without complicating the structure of the device such as by providing a separate reinforcing member.

The recording system according to a twelfth aspect is according to the eleventh aspect wherein the first leg section and the second leg section are provided at positions that overlap as viewed from a direction that intersects a direction in which the recording device and the post process device are arranged.

According to this aspect, the first leg section and the second leg section are provided at overlapping positions as viewed from a direction that intersects a direction in which the recording device and the post process device are arranged. Therefore, the recording system can be miniaturized in the direction that intersects the direction in which the recording device and the post process device are arranged.

The recording system according to an eleventh aspect wherein the first leg section and the second leg section are provided at positions that overlap as viewed from a direction in which the recording device and the post process device are arranged.

According to this aspect, the first leg section and the second leg section are provided at overlapping positions as viewed from a direction in which the recording device and the post process device are arranged. Therefore, the recording system can be miniaturized in the direction in which the recording device and the post process device are arranged.

First Embodiment

Hereinafter, an embodiment of the present disclosure will be described. First, an outline of a recording system 1 (recording system 1A) according to a first embodiment will be described with reference to FIGS. 1 to 3. As shown in FIG. 1, as an example, the recording system 1 includes a printer 10, a scanner unit 46, and a post process device 200 including a post process section 60 and a support section 100 that supports the post process section 60. The recording system 1 is configured as an inkjet type recording system that performs recording by ejecting ink Q, which is an example of liquid, onto a paper sheet P, which is an example of a medium.

An X direction is an example of a device depth direction of the recording system 1. A base end side of an arrow indicating the X direction is defined as a −X direction, and a tip end side of the arrow indicating the X direction is defined as a +X direction. The X direction is an example of the width direction of the paper sheet P. A Y direction is an example of the device width direction of the recording system 1. A tip end side of an arrow indicating the Y direction is defined as a +Y direction, and a base end side of the arrow indicating the Y direction is defined as a −Y direction. A Z direction is an example of the device height direction of the recording system 1, and is a direction perpendicular to both the X direction and the Y direction. A tip end side of an arrow indicating the Z direction is defined as a +Z direction, and a base end side of the arrow indicating the Z direction is defined as a −Z direction. In the following description, the +Z direction may be referred to as upward and the −Z direction may be referred to as downward. Here, upward and downward are upward and downward in a gravity direction. When + and − are not distinguished in each direction, the directions are simply described to as X direction, Y direction, and Z direction.

The printer 10 is an example of a recording device that performs recording on the paper sheet P. The printer 10 is positioned inside an installation area S1 set on a floor 2. As an example, the printer 10 includes a device main body 12, a sheet accommodation section 28 that accommodates the paper sheet P, a sheet transport section 44 that transports the paper sheet P, a recording section 50 that performs recording on the paper sheet P, a discharge section 52 that discharges the paper sheet P, a placement section 32 on which the discharged paper sheet P is placed, a relay unit 42 that transports the paper sheet P on the placement section 32, and a control section (not illustrated).

The device main body 12 includes a main body frame (not illustrated), an attachment frame (not illustrated) attached to the main body frame, a housing 16 forming an outer shell of the device main body 12, and a manual feed tray 18. The sheet accommodation section 28 is provided below the center of the device main body 12 in the Z direction. The sheet accommodation section 28 includes, as an example, four sheet cassettes 29 and an opening and closing section 34 shown in FIGS. 2 and 3. The sheet transport section 44 includes, as an example, a pickup roller, a sheet feed roller, a separation roller, a plurality of transport rollers, a belt unit, and a motor, which are not showing. The sheet transport section 44 constitutes a transport path T through which the paper sheet P is transported.

The transport path T includes, as an example, a vertical transport path T1, a manual feed path T2, a straight path T3, a discharge path T4, a switchback path T5, and an inversion path T6. The vertical transport path T1 is provided at the end section of the sheet accommodation section 28 in the −Y direction and extends in the +Z direction. The vertical transport path T1 is a path along which the paper sheet P fed from each sheet cassette 29 is transported.

The manual feed path T2 is a path extending from the manual feed tray 18 in the +Y direction, and merges with the vertical transport path T1 and connects to the straight path T3. The straight path T3 is a path extending linearly along the Y direction. The straight path T3 is opposed to a recording section 50 (to be described later) in the Z direction. The discharge path T4 is formed in a C-shape from the straight path T3 to the discharge section 52 (to be described later). The switchback path T5 temporarily receives the paper sheet P recorded in the recording section 50. The paper sheet P in the switchback path T5 is sent into the inversion path T6. A part of the inversion path T6 is provided at a position in the +Z direction with respect to the recording section 50 and in the −Z direction with respect to the placement section 32. In addition, a part of the inversion path T6 can be opened by rotating a part of the placement section 32.

Figure 2:
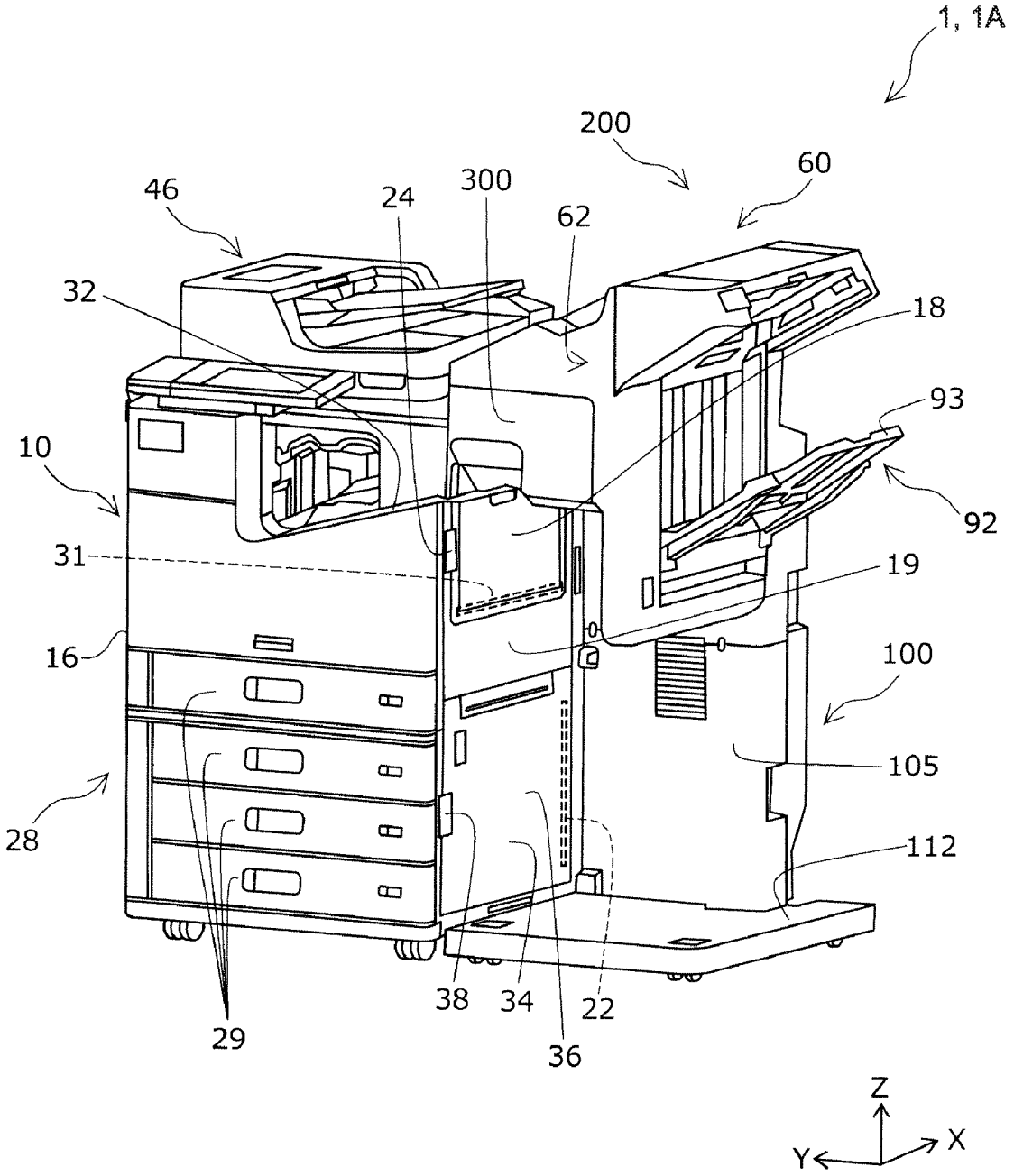
FIG. 2 is a perspective view of the recording system of FIG. 1.
Figure 3:
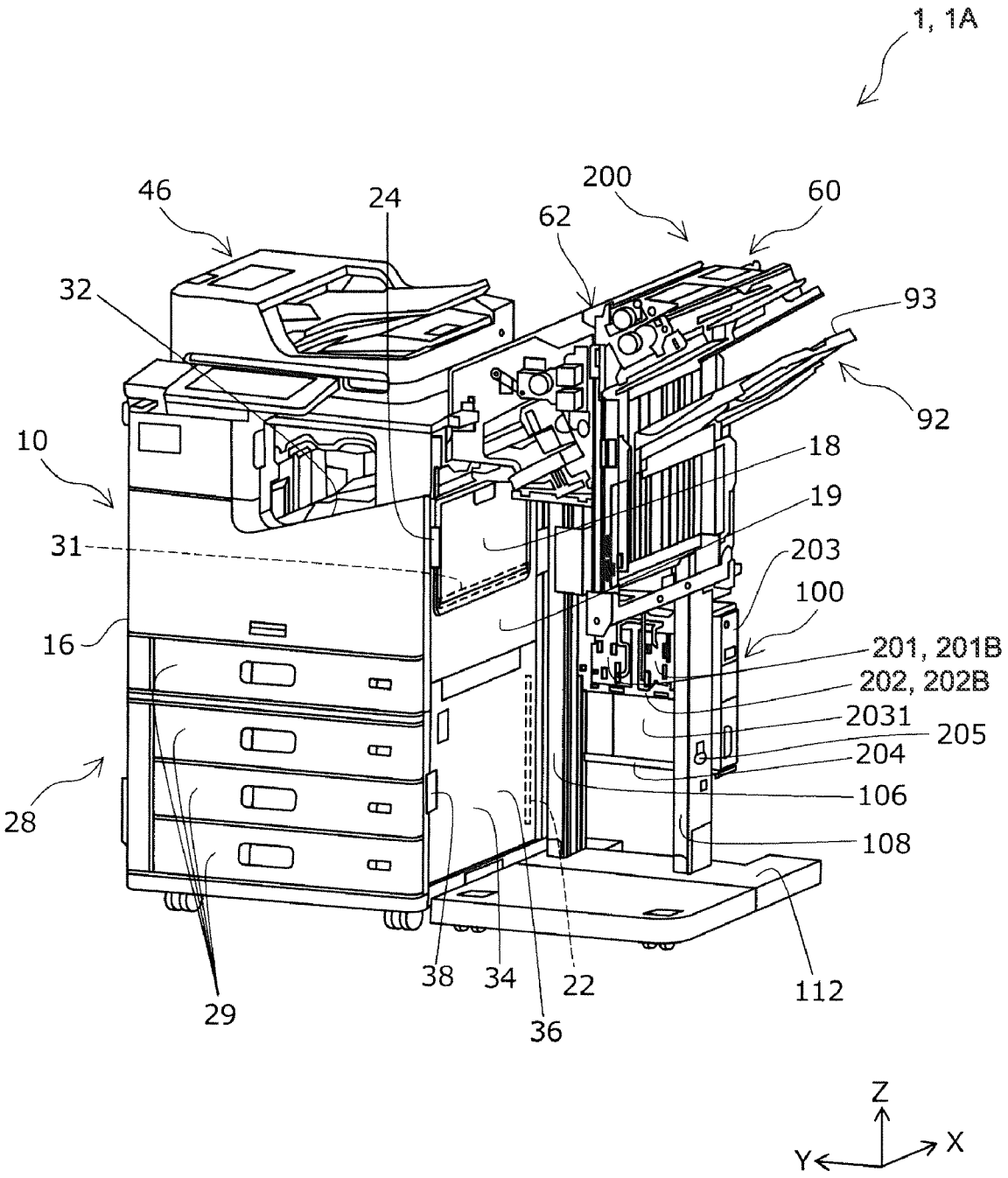
FIG. 3 is a perspective view of the recording system of FIG. 1, showing a state in which an outer cover of a post process device is removed.

The opening and closing section 34 is provided rotatably about a rotation shaft 22 extending in the Z direction shown in FIGS. 2 and 3. The opening and closing section 34 is an example of a process section that can perform processing by being moved outward from the main body of the sheet accommodation section 28. As an example, the process in the opening and closing section 34 is a process of removing a paper sheet P that remains in the vertical transport path T1. As shown in FIGS. 2 and 3, the opening and closing section 34 includes, as an example, a cover member 36 and an operation lever 38.

The manual feed tray 18 is an example of a process section that can process by being moved outward from the device main body 12. The process of the manual feed tray 18 means a process of feeding the paper sheet P along the manual feed path T2. As shown in FIGS. 2 and 3, the manual feed tray 18 is rotatably provided around a shaft section 31 extending in the X direction. That is, the manual feed tray 18 is switchable between a closed state and an opened state by rotating around the shaft section 31. When the manual feed tray 18 is in the opened state, the paper sheet P can be placed thereon.

A peripheral wall section 19 located at a peripheral edge of the manual feed tray 18 in the housing 16 is configured to be openable and closable about a shaft section (not illustrated) extending in the Z direction, as an example. Opening and closing of the peripheral wall section 19 is performed by operating a lever member 24. The lever member 24 is provided at an edge section of the peripheral wall section 19 in the −X direction with respect to the manual feed tray 18.

As shown in FIG. 1, the recording section 50 is configured as a line head as an example. The recording section 50 includes a plurality of nozzles (not illustrated) arranged over the entire area of the paper sheet P in the X direction. The recording section 50 performs recording on the paper sheet P by ejecting ink Q supplied from an ink tank (not illustrated) toward the paper sheet P from the plurality of nozzles. The discharge section 52 is provided in the device main body 12. Further, the discharge section 52 discharges the paper sheet P on which recording by the recording section 50 has been performed to the relay unit 42 or to the placement section 32. The discharge section 52 includes, as an example, a discharge roller pair 56. An opening through which the paper sheet P is sent out toward the post process section 60 of the post process device 200 is provided at a portion corresponding to the discharge section 52 on a −Y direction side section of the device main body 12.

As illustrated in FIG. 1, as an example, the placement section 32 is provided in the device main body 12 in order to discharge the medium to the inside of the apparatus main body 12. The placement section 32 has a placement surface 32A. The placement surface 32A extends in a direction that intersects the Y direction and obliquely upward toward the post process section 60. The relay unit 42 is positioned upward with respect to the placement section 32. The relay unit 42 receives the paper sheet P ejected from the discharge section 52 and transports the paper sheet P to the post process section 60.

A control section (not illustrated) of the printer 10 is configured to include a central processing unit (CPU, not illustrated), a read only memory (ROM), a random access memory (RAM), and a storage. The control section controls the transport operation of the paper sheet P in the printer 10, the discharge operation of the paper sheet P from the discharge section 52, and the operation of each section including the recording section 50 and the relay unit 42. The scanner unit 46 is attached to an upper end section of the printer 10. The scanner unit 46 reads information on a document (not illustrated).

The post process section 60 is positioned above the opening and closing section 34 that has been moved to the opened position. The post process section 60, as an example, performs a post process on the paper sheet P received from the discharge section 52 of the printer 10. That is, the post process section 60 is disposed downstream of the discharge section 52 in the discharge direction of the paper sheet P. As an example, the post process section 60 includes a main body section 62 including a housing, a stapler 88, and a movable tray 92. In addition, the post process section 60 includes a post process path T7 through which the paper sheet P sent from the relay unit 42 is transported.

As an example of a post process, the stapler 88 performs staple process for binding a predetermined number of paper sheets P. The stack of paper sheets P stapled by the stapler 88 is discharged to the movable tray 92. Other examples of post processes for the paper sheet P include a punching process for punching holes in the paper sheet P, a folding process for folding a bundle of the sheets P, a cutting process for cutting the paper sheet P, a folding process for folding the paper sheet P, and a bookbinding process for bookbinding the sheets P.

Figure 4:
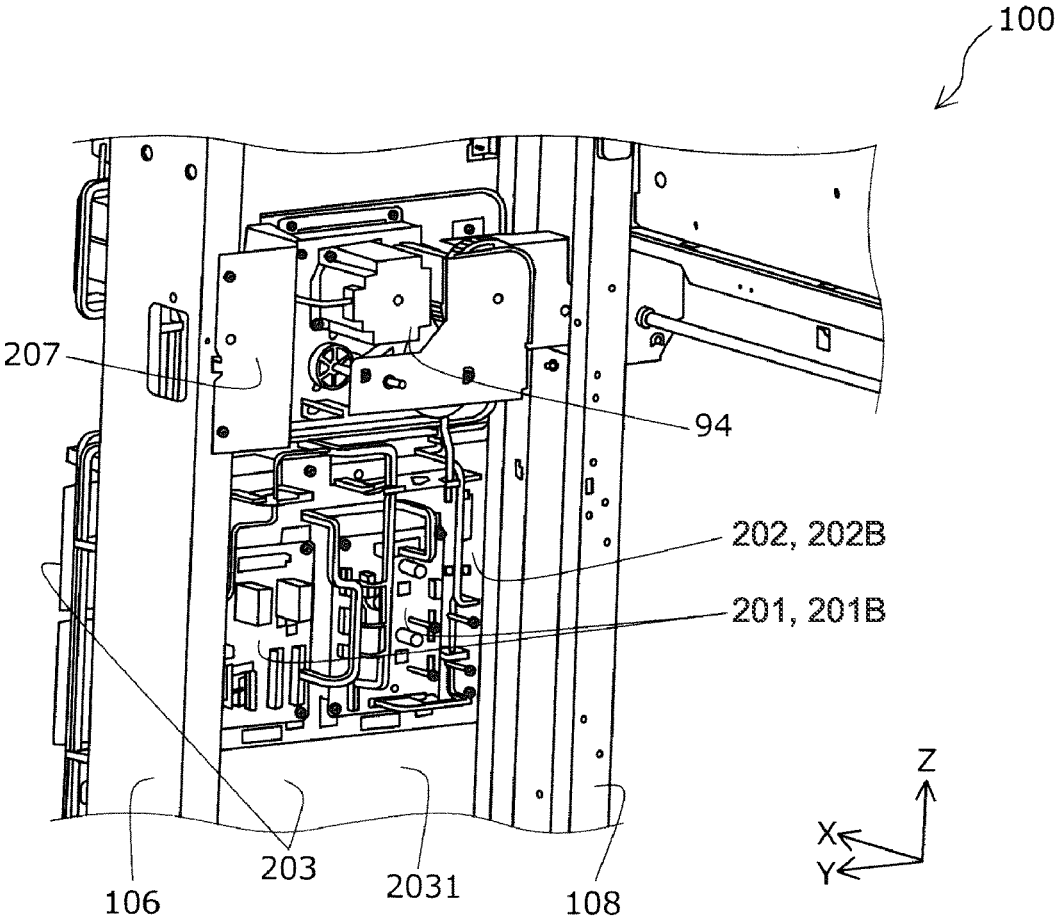
FIG. 4 is a perspective view showing a periphery of a second control section support and a drive section of the post process device of the recording system of FIG. 1.

The movable tray 92 is provided on a −Y direction side section of the main body section 62. The movable tray 92 includes a tray 93 and a drive section 94 that drives the tray 93 and is shown in FIG. 4 and the like. The tray 93 is moved up and down in the Z direction by the drive section 94 according to the amount of paper sheet P stacked on the tray 93.

Figure 5:
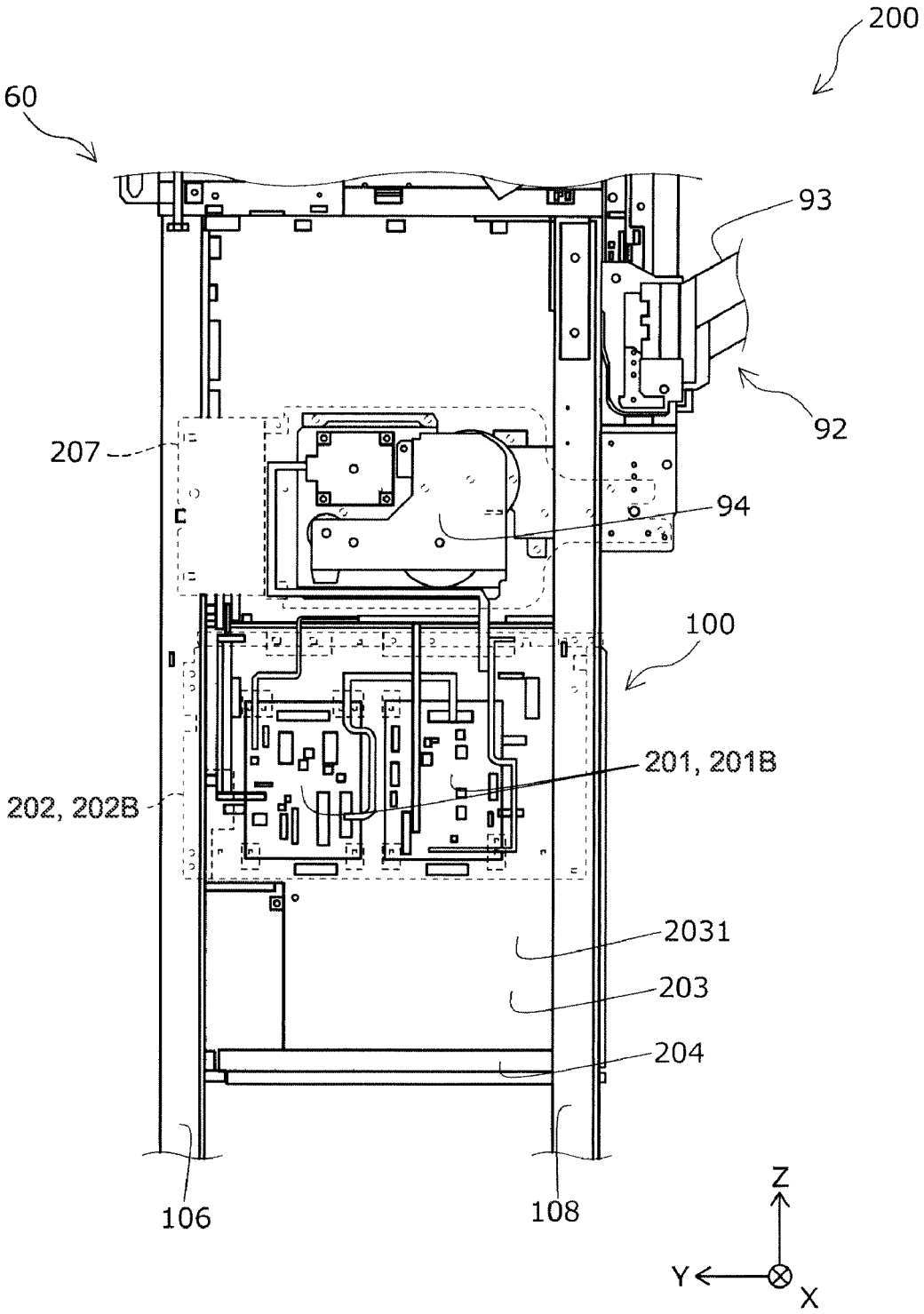
FIG. 5 is a front view showing internal structure of the post process device of the recording system of FIG. 1.
Figure 6:
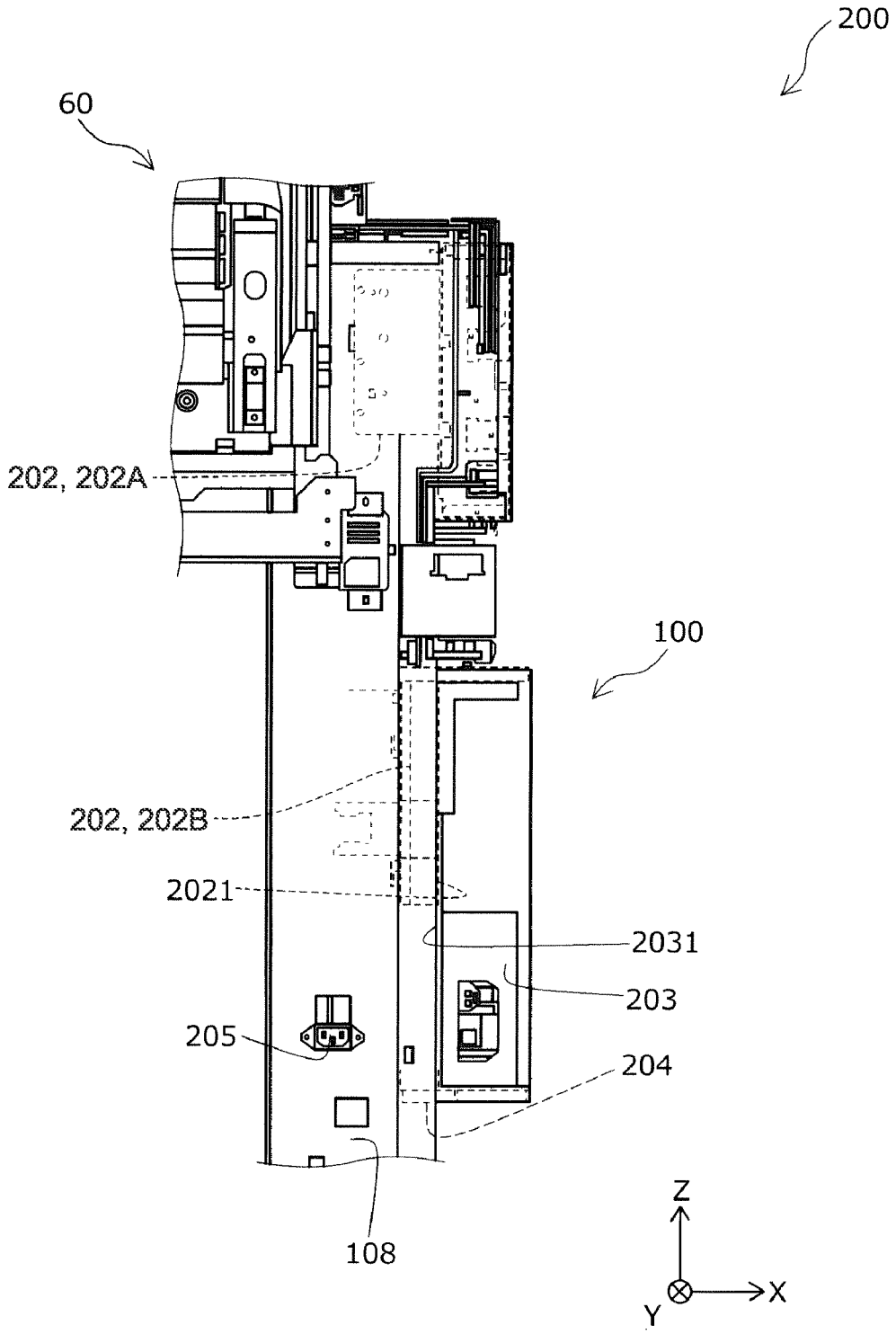
FIG. 6 is a side view showing internal structure of the post process device of the recording system of FIG. 1.
Figure 7:
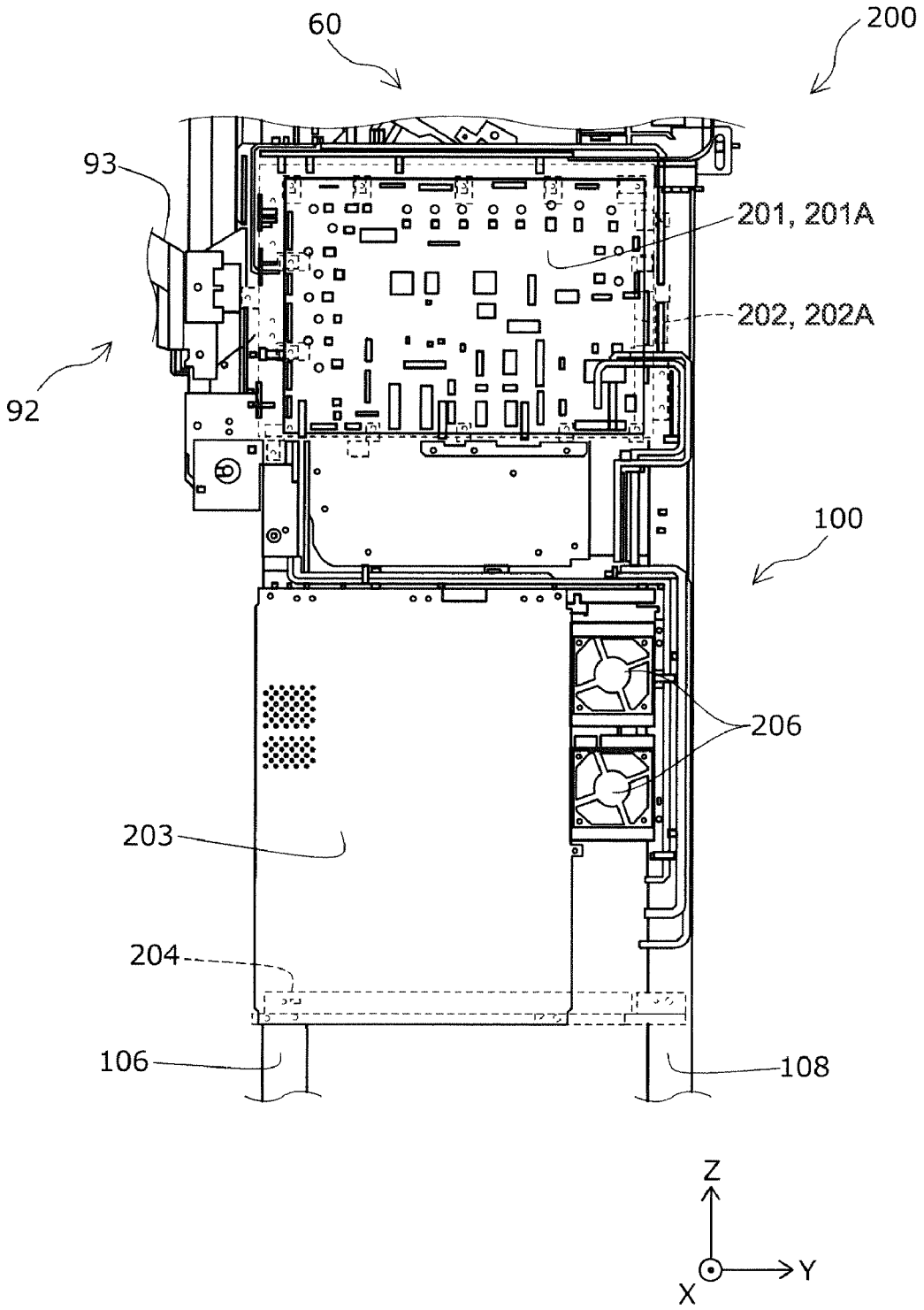
FIG. 7 is a rear view showing internal structure of the post process device of the recording system of FIG. 1.

Further, as shown in FIG. 1, the post process device 200 of the present embodiment includes the support section 100 in a lower section of the post process section 60. Details of the post process device 200 will be described below with reference to FIGS. 4 to 14 in addition to FIGS. 1 to 3, with a main focus on the specific configuration of the support section 100. In FIGS. 5 to 7, to facilitate understanding of the internal configuration, some constituent members, such as a first control section support 202A, a second control section support 202B, a power supply section support 204, and a drive section support 207, are represented by dashed lines, including visible portions. The post process device 200 of this embodiment is a post process device that performs post process on the paper sheet P as the medium received from the printer 10 as the recording device, and includes, as shown in FIGS. 2 and 3, the post process section 60 that performs post process on the printed paper sheet P, an installation section 112 disposed below the post process section 60 in the gravity direction, and the support section 100 provided between the post process section 60 and the installation section 112.

As shown in FIG. 2, the support section 100 has an outer cover 105. As shown in FIG. 3, a first leg section 106, which is fixed to the installation section 112 and which extends in the +Z direction from the installation section 112 toward the post process section 60, and a second leg section 108, which is fixed to the installation section 112 at a position different from the first leg section 106 and which extends in the +Z direction from the installation section 112 toward the post process section 60, are provided inside the outer cover 105 of the support section 100. The first leg section 106 and the second leg section 108 are disposed at positions that overlap in the Y direction.

A control section 201 that controls the operation of the post process device 200 is provided inside the outer cover 105 of the support section 100. The control section 201 is supported by the control section support 202. Here, the control section 201 includes a first substrate 201A shown in FIG. 7 and a second substrate 201B shown in FIGS. 4 and 5. The first substrate 201A is supported by the first control section support 202A as the control section support 202, and the second substrate 201B is supported by the second control section support 202B as the control section support 202. Note that both the first substrate 201A and the second substrate 201B as the control section 201 include at least one of the central process section (CPU, not illustrated), the read only memory (ROM), the random access memory (RAM), the storage, or the like.

Here, both the first control section support 202A and the second control section support 202B connect the first leg section 106 and the second leg section 108 to each other. That is, in the post process device 200 according to the present embodiment, by adopting a configuration in which a constituent member that can be said to be essential, that is, the control section support 202 that supports a control section 201 that controls the operation of the post process device 200, to connect the first leg section 106 and the second leg section 108 together, then it is possible to give the configuration member the additional role of stably supporting the post process section 60. Therefore, the post process device 200 of the present embodiment can stably support the post process section 60 without complicating the structure of the device such as by providing a separate reinforcing member. In the present embodiment, the first substrate 201A and the second substrate 201B are provided as the control section 201, but the number of control sections 201 is not particularly limited. In a case where a plurality of control sections 201 are provided, a configuration in which the control section support 202 that corresponds to any one of the control sections 201 connects the first leg section 106 and the second leg section 108 together is included in the present disclosure.

Describing the above from the viewpoint of the recording system 1, the recording system 1A of the present embodiment is the recording system including the printer 10 as the recording device that performs recording on the paper sheet P as the medium, and the post process device 200 that has the above configuration that performs post process on the paper sheet P received from the printer 10. Therefore, the recording system 1A of the present embodiment can stably support the post process section 60 without complicating the structure of the device such as by providing a separate reinforcing member.

Here, the first leg section 106, the second leg section 108, the first control section support 202A, and the second control section support 202B are all configured from metal. As described above, it is desirable that the first leg section 106, the second leg section 108, and the control section support 202 include metal members, that the metal member of the first leg section 106 and the metal member of the control section support 202 be in contact with each other, and that the metal member of the second leg section 108 and the metal member of the control section support 202 be in contact with each other. This is because, since the metal members have high conductivity, with such a configuration, the number of electrical contact points between the first leg section 106 and the second leg section 108 increases, and generation of a large potential difference between the first leg section 106 and the second leg section 108 can be suppressed. Further, since the metal members are sturdy, the post process section 60 can be stably supported by such a configuration.

As shown in FIG. 6, the first control section support 202A has a box shape having a depth such that the −X direction is the depth direction, and the first substrate 201A is attached from the +X direction side on a −X direction surface of the first control section support 202A. In other words, the first control section support 202A as the control section support 202 has a box shape, and the first substrate 201A as the control section 201 is housed in the first control section support 202A. Therefore, in the present embodiment, the first control section support 202A can physically protect the first substrate 201A, and the first control section support 202A can take on a role of an electromagnetic shield for the first substrate 201A. It should be noted that box shaped control section support 202 means that the control section 201 can be substantially accommodated, and includes, for example, a case in which a part of the control section 201 protrudes.

As shown in FIGS. 4 and 6, the second substrate 201B as the control section 201 is provided between the first leg section 106 and the second leg section 108. As is apparent from the fact that the second substrate 201B is hidden by the second leg section 108 and cannot be seen in FIG. 6, the second substrate 201B is provided so as to overlap the first leg section 106 and the second leg section 108 as viewed in the Y direction in which the first leg section 106 and the second leg section 108 overlap. With such a configuration, it becomes easy to miniaturize the post process device 200.

As shown in FIGS. 3 to 7, the post process device 200 of the present embodiment includes a power supply section 203 for supplying electricity to the post process section 60. As shown in FIGS. 5 to 7 and the like, the post process device 200 according to the present embodiment includes a power supply section support 204 that supports the power supply section 203 and connects the first leg section 106 and the second leg section 108 together. In this manner, by adopting a configuration in which the power supply section support 204 that supports the power supply section 203 connects the first leg section 106 and the second leg section 108 together, then it is possible to give the configuration member the additional role of stably supporting the post process section 60. Therefore, the post process device 200 of the present embodiment is configured to be able to further stably support the post process section 60 without complicating the structure of the device such as by providing a separate reinforcing member. Furthermore, as is the case of the post process device 200 of the present embodiment, configuring the second control section support 202B to extend in the X direction, which intersects the Z direction in which the first leg section 106 and the second leg section 108 extend, results in a parallel cross shape with respect to the first leg section 106 and the second leg section 108, and thus the post process section 60 can be particularly stably supported.

As shown in FIG. 7, the power supply section 203 is disposed below the first substrate 201A of the control section 201 in the gravity direction. Although the power supply section 203 is generally heavy, disposing the power supply section 203 below the control section 201 in the gravity direction can lower the centroid of the post process device 200 and can improve the installation stability of the post process device 200.

Further, as shown in FIGS. 3 to 6, the second control section support 202B of the control section support 202 extends in the Y direction, which intersects the Z direction in which the first leg section 106 and the second leg section 108 extend, however as shown in FIG. 6, the second control section support 202B has a contact surface 2021 in surface contact with the −X direction side surface 2031 of the power supply section 203. Therefore, in the post process device 200 according to the present embodiment, in addition to the power supply section support 204, by bringing the second control section support 202B into surface contact with the power supply section 203 to support the power supply section 203, the power supply section 203 can be particularly stably supported. Further, as in the post process device 200 of the present embodiment, by making the second control section support 202B in a configuration that has the contact surface 2021 extending in the Y direction, which intersects the Z direction in which the first leg section 106 and the second leg section 108 extend, it will have the contact surface 2021 in a parallel cross shape with respect to the first leg section 106 and the second leg section 108, and the post process section 60 can be particularly stably supported.

Further, as shown in FIG. 6, in the post process device 200 of the present embodiment, a socket 205 for supplying electricity from outside to the power supply section 203 is provided on a side surface 1081 of the second leg section 108, which is the Y direction surface where the first leg section 106 and the second leg section 108 overlap. As described above, it is desirable that the socket 205 for supplying electricity from the outside to the power supply section 203 is provided on the side surface of at least one of the first leg section 106 and the second leg section 108. This is because with such a configuration, it is easy to miniaturize the post process device 200, and usability with respect to the socket 205 from the side surface 1081 side is improved.

Further, as shown in FIG. 7, the post process device 200 of the present embodiment includes an air cooling section 206 that air-cools the power supply section 203. The air cooling section 206 of the present embodiment is attached to a housing portion of the power supply section 203. However, it is not limited to such a configuration. For example, a configuration may be adopted in which an air cooling section support that supports the air cooling section 206 is provided, and the air cooling section support connects the first leg section 106 and the second leg section 108. In this way, by adopting a configuration in which the air cooling section support that supports the air cooling section 206 is connected to the first leg section 106 and the second leg section 108, it is possible to give it the additional role of stably supporting the post process section 60, and the post process section 60 can be further stably supported without complicating the configuration such as by providing a separate reinforcing member.

In addition, as described above, the post process device 200 according to the present embodiment includes the tray 93 on which the paper sheet P subjected to the post process is placed and the drive section 94 which changes the position of the tray 93 in the gravity direction. In addition, as shown in FIGS. 4 and 5, the post process device 200 according to the present embodiment includes the drive section support 207 that supports the drive section 94 and connects the first leg section 106 and the second leg section 108. In this way, by adopting a configuration in which the drive section support 207 that supports the drive section 94 is connected to the first leg section 106 and the second leg section 108, it is possible to give it the additional role of stably supporting the post process section 60. Therefore, the post process device 200 of the present embodiment is configured to be able to further stably support the post process section 60 without complicating the structure of the device such as by providing a separate reinforcing member.

Each of the first leg section 106 and the second leg section 108 has a substantially rectangular cross section as viewed in the Z direction, and includes a surface along the X direction and a surface along the Y direction. Since each of the first control section support 202A, the second control section support 202B, the power supply section support 204, and the drive section support 207 has a surface along the Y direction, each of the first leg section 106 and the second leg section 108 is attached so as to be in surface contact with the surface along the Y direction. Therefore, the first control section support 202A, the second control section support 202B, the power supply section support 204, and the drive section support 207 are all stably fixed to the first leg section 106 and the second leg section 108.

Further, the first leg section 106 and the second leg section 108 are rod-shaped and tend to have characteristics like an antenna. When they have characteristics like an antenna, electric characteristics in the control section 201 or the like might deteriorate. However, in addition to the installation section 112, since the first leg section 106 and the second leg section 108 are in electrical contact with each other at a plurality of positions in the Z direction such as by the first control section support 202A, the second control section support 202B, the power supply section support 204, and the drive section support 207, it is configured such that a potential difference between the first leg section 106 and the second leg section 108 in the Z direction is hardly generated.

Figure 8:
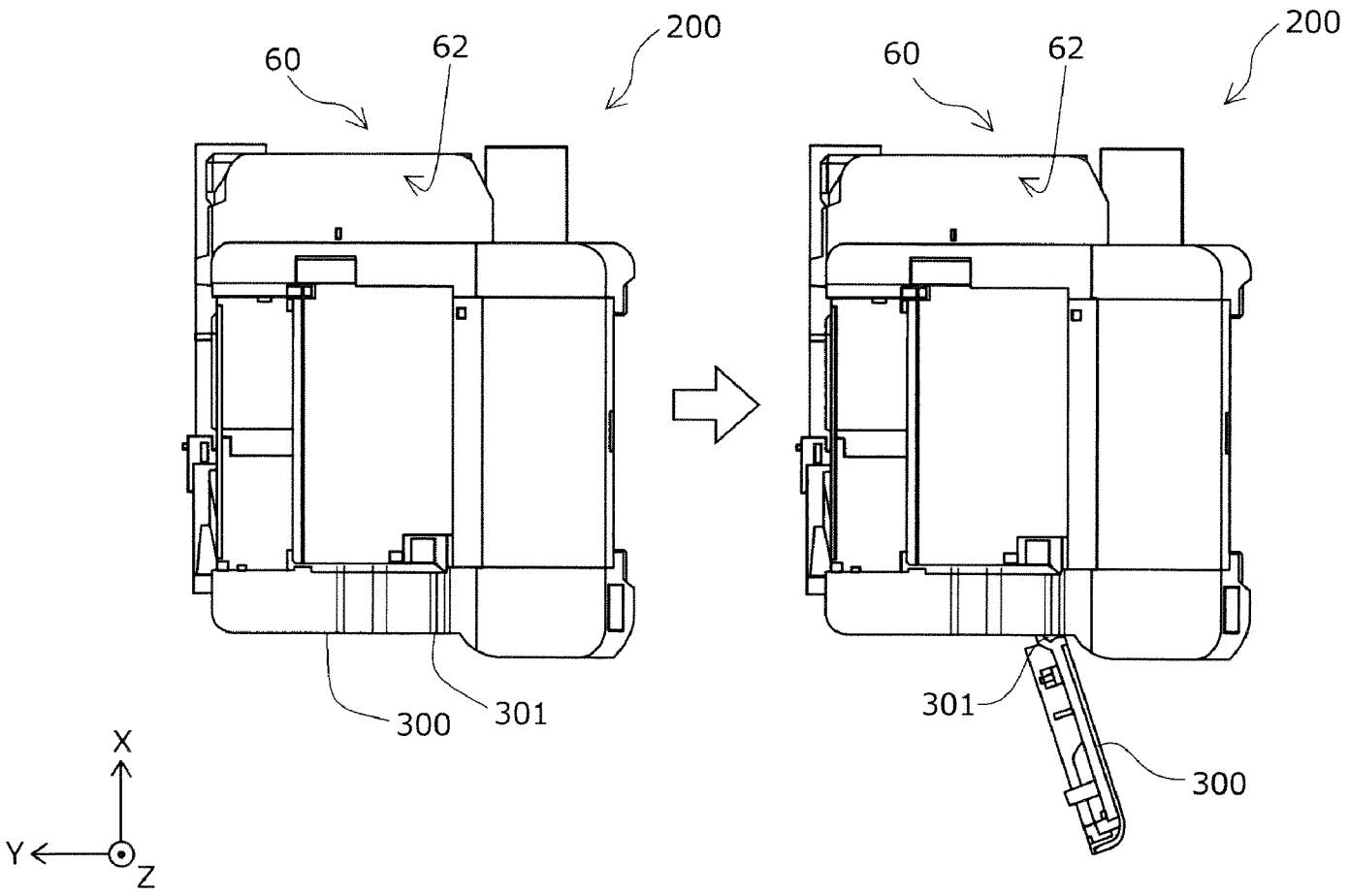
FIG. 8 is a plan view of the post process device of the recording system in FIG. 1, and is a diagram showing a state in which an opening and closing door is changed from a closed state to an opened state.

As shown in FIGS. 2 and 8, in the post process device 200 according to the present embodiment, the post process section 60 is provided with an opening and closing door 300 for allowing internal access. As shown in FIG. 8, the opening and closing door 300 is configured to be rotatable with respect to the main body section 62 around the rotation shaft section 301, which extends in the Z direction.

Figure 9:
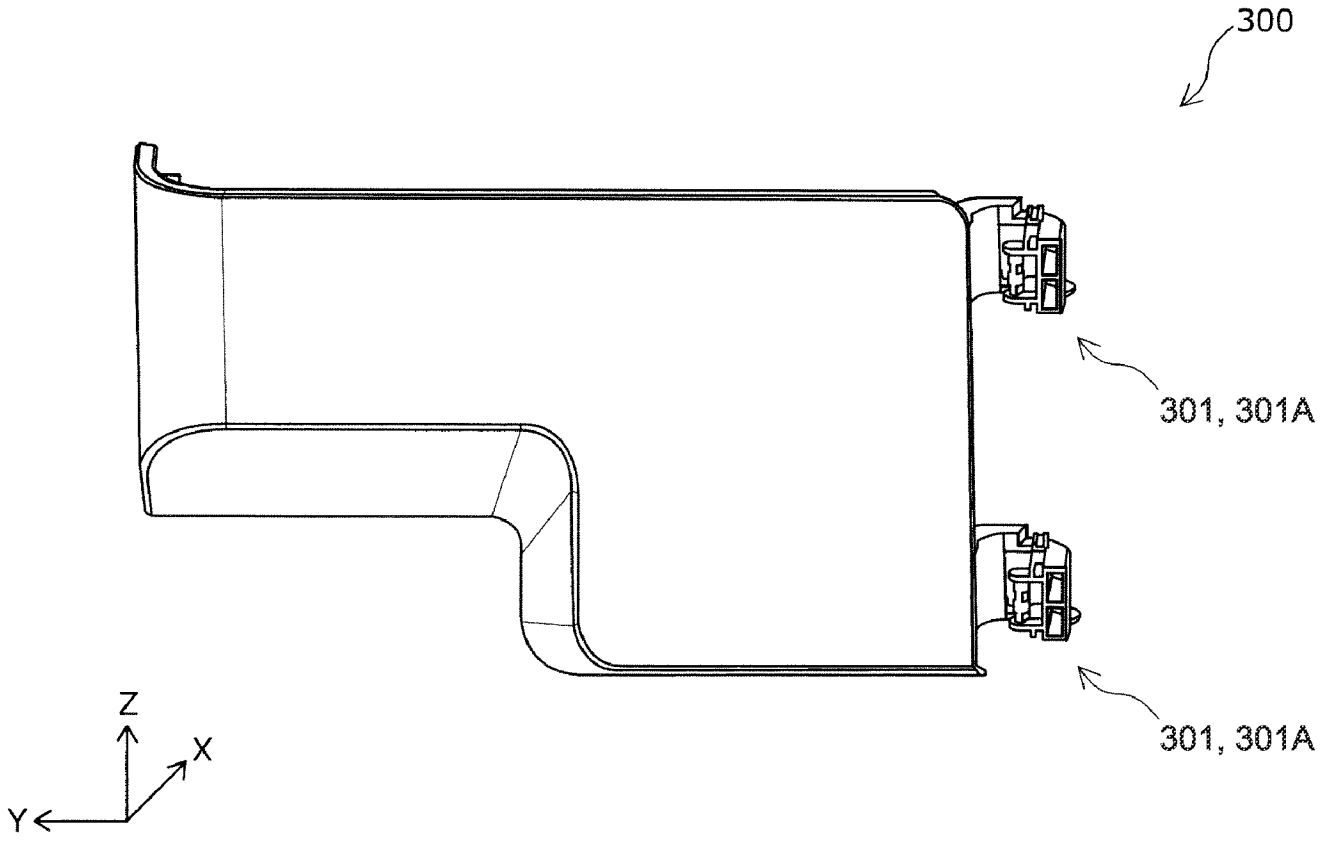
FIG. 9 is a perspective view showing the opening and closing door of the post process device of the recording system of FIG. 1.
Figure 11:
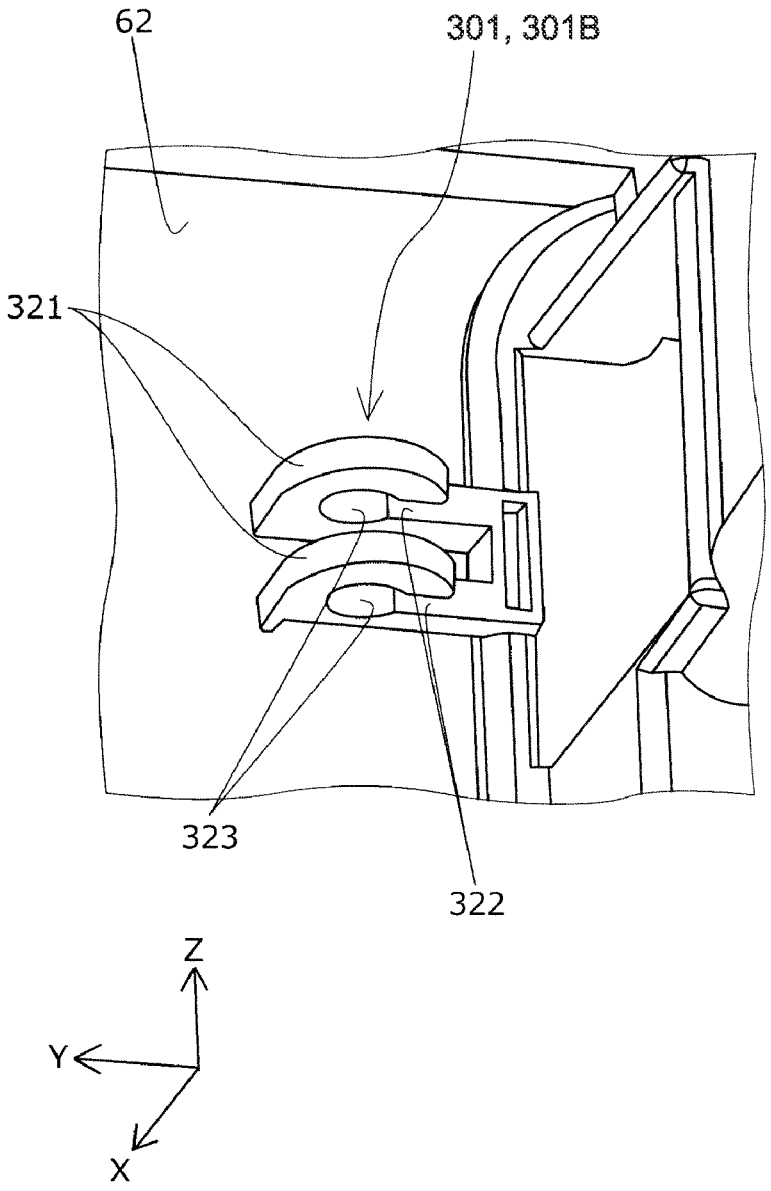
FIG. 11 is a perspective view showing a main body section side rotation shaft section that fits to the opening and closing door side rotation shaft section of FIG. 10, and that is provided on the main body section of the post process device of FIG. 8.

As shown in FIG. 9, the opening and closing door 300 has two opening and closing door side rotation shaft sections 301A constituting the rotation shaft section 301 along the Z direction. Further, main body section side rotation shaft sections 301B such as shown in FIG. 11 are provided at positions where they can fit into the opening and a closing door side rotation shaft sections 301A of the main body section 62. The rotation shaft sections 301A and the rotation shaft sections 301B constitute the rotation shaft section 301. Although two rotation shaft sections 301A and two rotation shaft sections 301B are provided, each rotation shaft section 301A has the same configuration, and each rotation shaft section 301B also has the same configuration.

Figure 10:
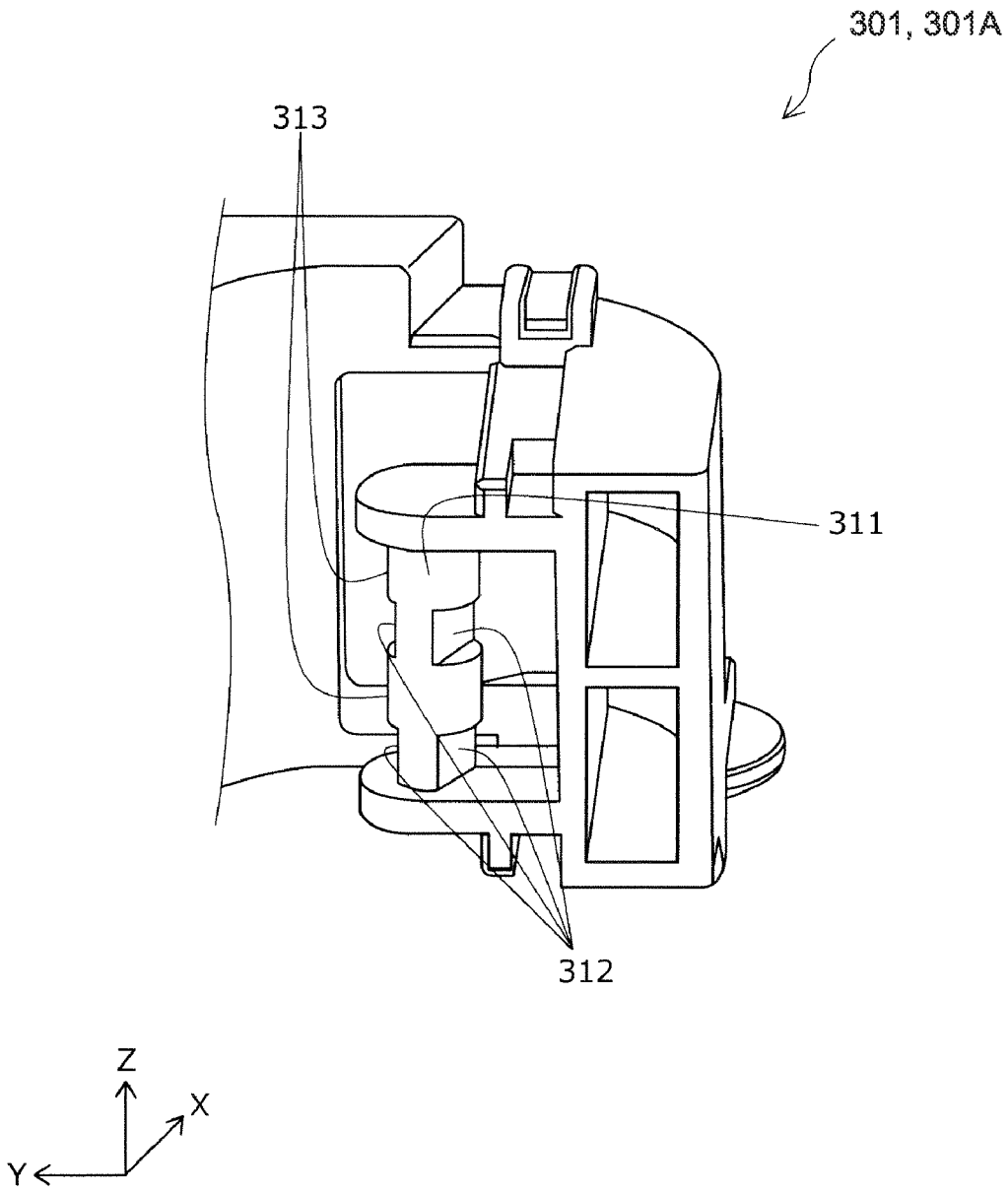
FIG. 10 is a perspective view showing the opening and closing door side rotation shaft section of the opening and closing door of FIG. 9.

As shown in FIG. 10, the rotation shaft section 301A is provided with a shaft section 311. The shaft section 311 is provided with cutout sections 312 in which parallel planes along the Z direction are formed by cutting out the same position in the Z direction, and cylindrical sections 313 in which the cutout sections 312 are not formed. As shown in FIG. 10, with respect to one shaft section 311, cutout sections 312 and cylindrical sections 313 are provided alternately at two positions in the Z direction.

On the other hand, as shown in FIG. 11, the rotation shaft sections 301B are provided with engagement sections 321 for engaging with the shaft section 311. The engagement sections 321 are provided at two positions in the Z direction with the same space in between them as the space between the cutout sections 312 in the Z direction. As shown in FIG. 11, the engagement section 321 has a pass-through section 322 through which the cutout section 312 can pass and whose facing surfaces are parallel to each other, and a fitting section 323 into which can be fitted the cylindrical section 313 to support the cylindrical section 313.

Figure 12:
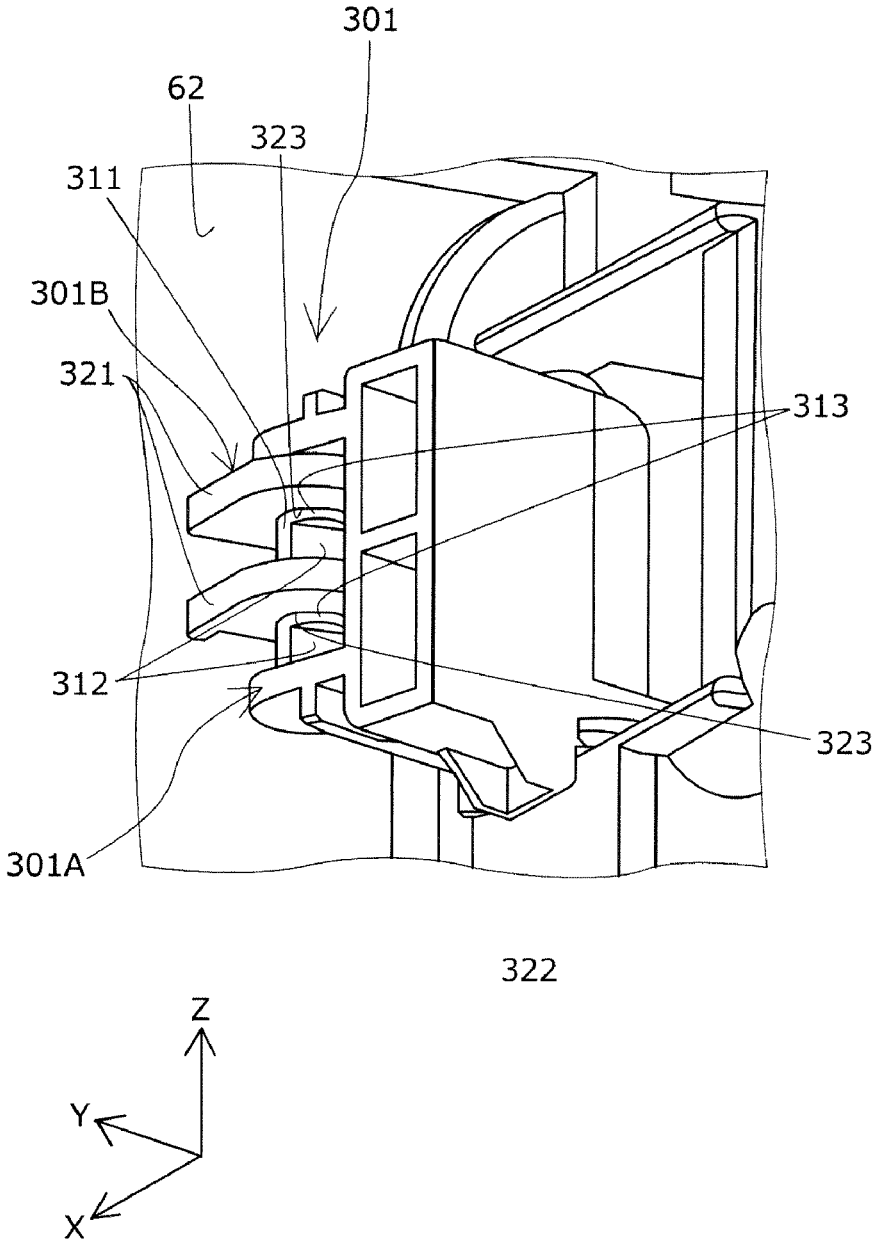
FIG. 12 is a perspective view showing the main body section of the post process device of FIG. 8 and the rotation shaft section of the opening and closing door of FIG. 9.
Figure 13:
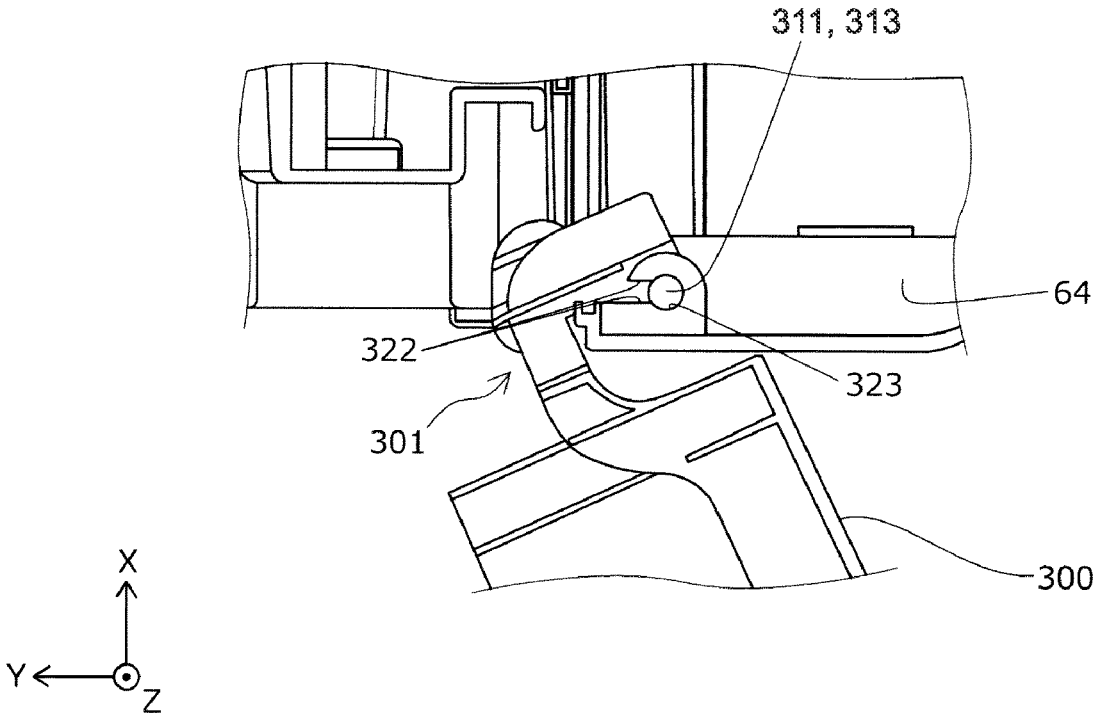
FIG. 13 is a plan sectional view showing the main body section of the post process device of FIG. 8 and the rotation shaft section of the opening and closing door of FIG. 9, and is a view showing a state in which the opening and closing door has already been fitted to the main body section.
Figure 14:
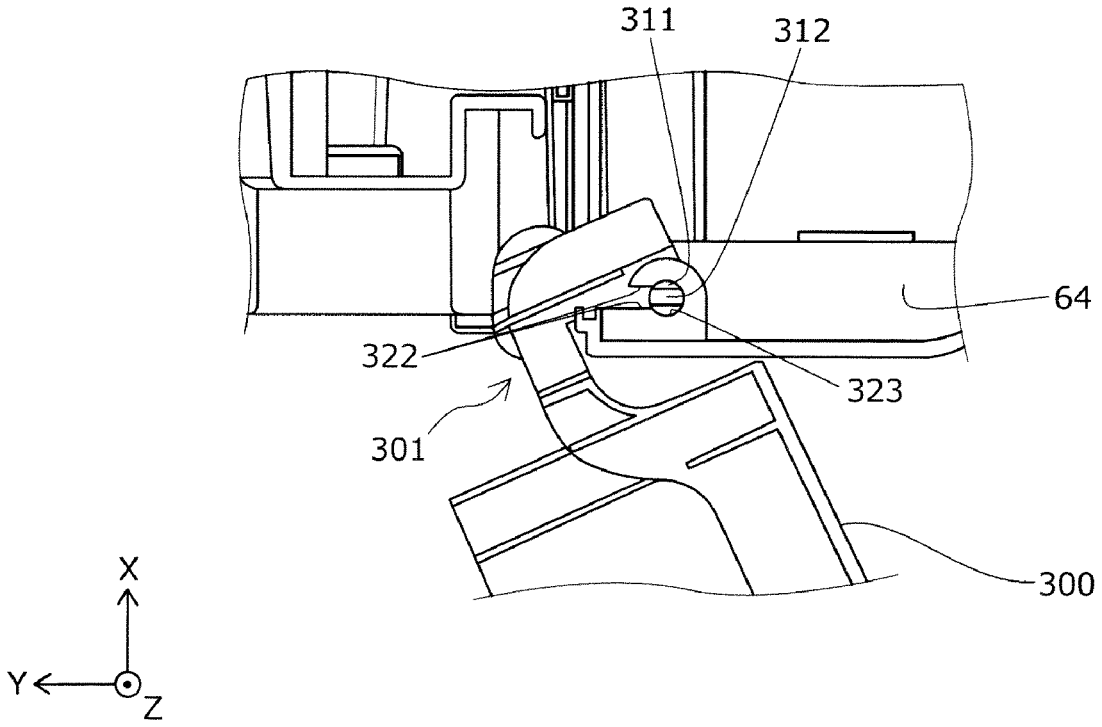
FIG. 14 is a plan sectional view showing the main body section of the post process device of FIG. 8 and the rotation shaft section of an opening and closing door of FIG. 9, and is a view showing a state at the time of fitting the opening and closing door to the main body section.

When attaching the opening closing door 300 to the main body section 62, then as shown in FIG. 14, the cutout section 312 is aligned with the position of the pass-through section 322 in the Z direction and the opening and closing door 300 is moved in the −Y direction with respect to the main body section 62. Then, when the shaft section 311 reaches the position of the fitting section 323, the opening and closing door 300 is moved in the −Z direction with respect to the main body section 62, and as shown in FIG. 13, the cylindrical section 313 is fitted into the fitting section 323. FIG. 12 shows a state in which the cylindrical section 313 is fitted into the fitting section 323, or in other words, a state in which the opening and closing door 300 is attached to the main body section 62.

On the other hand, when the opening and closing door 300 is detached from the main body section 62, the opening and closing door 300 is moved in the +Z direction with respect to the main body section 62 from a state in which the cylindrical section 313 shown in FIG. 13 is fitted to the fitting section 323. Then, as shown in FIG. 14, the cutout section 312 is aligned with the position of the pass-through section 322 in the Z direction and the opening and closing door 300 is moved in the +Y direction with respect to the main body section 62. In present embodiment, since a force to move the opening and closing door 300 in the −Z direction due to its own weight is applied to the opening and closing door 300, after the opening and closing door 300 is attached to the main body section 62, the possibility that a user unintentionally detaches the opening and closing door 300 from the main body section 62 is suppressed.

Second Embodiment

Hereinafter, a recording system 1B according to a second embodiment will be described with reference to FIG. 15. The recording system 1B of the present embodiment is the same as the recording system 1A of the first embodiment except for the configuration described below. In detail, compared to the recording system 1A of the first embodiment, only the configuration of the support section 100 of the post process device 200 is different from that of the recording system 1A of the first embodiment. Therefore, the recording system 1B of the present embodiment has the same features as the recording system 1A of the first embodiment except for the following description. Therefore, in FIG. 15, constituent members common to the first embodiment are denoted by the same reference symbols, and detailed description thereof will be omitted.

As shown in FIG. 2 and the like, in the recording system 1A of the first embodiment, the support section 100 is provided in the vicinity of the +X direction side end section of the installation section 112. For this reason, in the recording system 1A of first embodiment, as shown in FIG. 3 and the like, the first leg section 106 and the second leg section 108 are provided at positions overlapping as viewed from the Y direction. That is, the first leg section 106 and the second leg section 108 are provided at positions that overlap each other as viewed in the Y direction (device width direction), which is the direction in which the printer 10 and the post process device 200 are arranged. For this reason, it is possible to miniaturize the recording system 1A in the direction in which the printer 10 and the post process device 200 are arranged.

Figure 15:
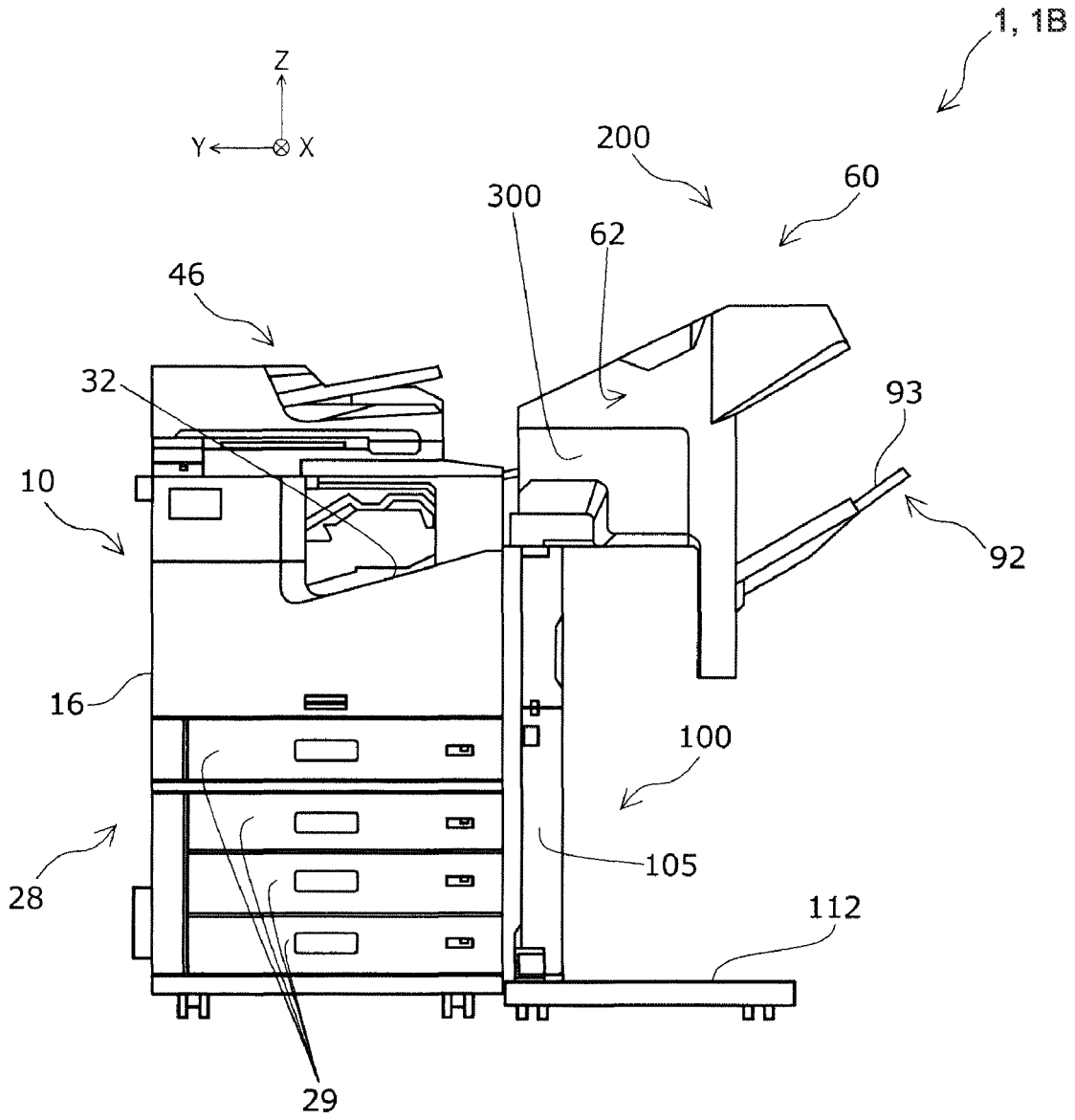
FIG. 15 is a front view showing an overall configuration of the recording system according to a second embodiment of the present disclosure.

On the other hand, as shown in FIG. 15, in the recording system 1B of this embodiment, the support section 100 is provided in the vicinity of the +Y direction side end section of the installation section 112. For this reason, in the recording system 1B of present embodiment, the first leg section 106 and the second leg section 108 are provided at positions overlapping as viewed from the X direction. That is, the first leg section 106 and the second leg section 108 are provided at positions that overlap each other as viewed in the X direction (device depth direction), which is a direction that intersects the direction (Y direction) in which the printer 10 and the post process device 200 are arranged. Therefore, it is possible to miniaturize the recording system 1B in the direction that intersects the direction in which the printer 10 and the post process device 200 are arranged. In addition, in the recording system 1A of Example 1, it is easy to access the inside of the printer 10 through the opening and closing section 34 or the like, whereas the recording system 1B of the present example, as shown in FIG. 15 gives the strong impression that the post process section 60 is floating, and the appearance is good.

It is to be noted that the present disclosure is not limited to the above described embodiments, and various modifications can be made within the scope of the disclosure described in the claims, and these modifications are also included within the scope of the present disclosure.

What is claimed is:

1. A post process device configured to perform a post process on a medium received from a recording device, comprising:

a post process section configured to perform the post process;

an installation section disposed below the post process section in a gravity direction;

a first leg section that is fixed to the installation section and that extends from the installation section toward the post process section;

a second leg section that is fixed to the installation section at a position different from the first leg section and that extends from the installation section toward the post process section;

a control section configured to control an operation of the post process device;

a control section support configured to support the control section and to connect the first leg section and the second leg section to each other;

a tray configured to place the medium on which the post process is performed;

a drive section configured to change a position of the tray in the gravity direction; and a drive section support configured to support the drive section and to connect the first leg section and the second leg section to each other.

2. The post process device according to claim 1, wherein the first leg section, the second leg section, and the control section support include metal members and the metal member of the first leg section and the metal member of the control section support are in contact with each other, and the metal member of the second leg section and the metal member of the control section support are in contact with each other.

3. The post process device according to claim 1, wherein the control section support is box shaped and the control section is housed in the control section support.

4. The post process device according to claim 1, further comprising:

a power supply section configured to supply electricity to the post process section and a power supply section support configured to support the power supply and to connect the first leg section and the second leg section to each other.

5. The post process device according to claim 4, wherein the power supply section is disposed below the control section in the gravity direction.

6. The post process device according to claim 4, wherein the control section support is provided to extend in a direction that intersects a direction in which the first leg section and the second leg section extend, and has a contact surface in surface contact with the power supply section.

7. The post process device according to claim 4, further comprising:

a socket that is configured to supply electricity from outside to the power supply section and that is provided on a side surface of at least one of the first leg section and the second leg section, the side surface being a surface in a direction in which the first leg section and the second leg section overlap.

8. The post process device according to claim 4, further comprising:

an air cooling section configured to air cool the power supply section and an air cooling section support configured to support the air cooling section and to connect the first leg section and the second leg section to each other.

9. The post process device according to claim 1, wherein the control section is provided so as to overlap with the first leg section and the second leg section as viewed from a direction in which the first leg section and the second leg section overlap.

10. A recording system comprising:

a recording device configured to perform recording on a medium and a post process device configured to perform a post process on the medium received from the recording device, wherein the post process device includes a post process section configured to perform the post process, an installation section disposed below the post process section in a gravity direction, a first leg section that is fixed to the installation section and that extends from the installation section toward the post process section, a second leg section that is fixed to the installation section at a position different from the first leg section and that extends from the installation section toward the post process section, a control section configured to control an operation of the post process device, a control section support configured to support the control section and to connect the first leg section and the second leg section to each other, a power supply section configured to supply electricity to the post process section, and a power supply section support configured to support the power supply and to connect the first leg section and the second leg section to each other, wherein the control section support is provided to extend in a direction that intersects a direction in which the first leg section and the second leg section extend, and has a contact surface in surface contact with the power supply section.

11. The recording system according to claim 10, wherein the first leg section and the second leg section are provided at positions that overlap as viewed from a direction that intersects a direction in which the recording device and the post process device are arranged.

12. The recording system according to claim 10, wherein the first leg section and the second leg section are provided at positions that overlap as viewed from a direction in which the recording device and the post process device are arranged.

13. A recording system comprising:

a recording device configured to perform recording on a medium and a post process device configured to perform a post process on the medium received from the recording device, wherein the post process device includes a post process section configured to perform the post process, an installation section disposed below the post process section in a gravity direction, a first leg section that is fixed to the installation section and that extends from the installation section toward the post process section, a second leg section that is fixed to the installation section at a position different from the first leg section and that extends from the installation section toward the post process section, a control section configured to control an operation of the post process device, a control section support configured to support the control section and to connect the first leg section and the second leg section to each other, wherein the first leg section and the second leg section are provided at positions that overlap as viewed from a direction in which the recording device and the post process device are arranged.

14. The post process device according to claim 10, further comprising:

a socket that is configured to supply electricity from outside to the power supply section and that is provided on a side surface of at least one of the first leg section and the second leg section, the side surface being a surface in a direction in which the first leg section and the second leg section overlap.

15. The post process device according to claim 10, further comprising:

an air cooling section configured to air cool the power supply section, and an air cooling section support configured to support the air cooling section and to connect the first leg section and the second leg section to each other.

* * * * *